US009915911B2

(12) United States Patent
Mimura

(10) Patent No.: US 9,915,911 B2
(45) Date of Patent: Mar. 13, 2018

(54) OPTICAL SCANNING DEVICE AND IMAGE FORMING APPARATUS INCLUDING THE SAME

(71) Applicant: KYOCERA Document Solutions Inc., Osaka (JP)

(72) Inventor: Daisuke Mimura, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 15/469,904

(22) Filed: Mar. 27, 2017

(65) Prior Publication Data

US 2017/0277113 A1 Sep. 28, 2017

(30) Foreign Application Priority Data

Mar. 28, 2016 (JP) ..... 2016-064661

(51) Int. Cl.
*G03G 15/04* (2006.01)
*G03G 21/00* (2006.01)

(52) U.S. Cl.
CPC ..... *G03G 21/007* (2013.01); *G03G 15/04* (2013.01); *G03G 21/0058* (2013.01); *G03G 21/0005* (2013.01); *G03G 2221/0005* (2013.01); *G03G 2221/0047* (2013.01); *G03G 2221/0089* (2013.01)

(58) Field of Classification Search
CPC ..... G03G 15/04; G03G 21/0005; G03G 21/0058; G03G 21/007; G03G 2221/0005; G03G 2221/0047; G03G 2221/0089
See application file for complete search history.

(56) References Cited

U.S. PATENT DOCUMENTS 9,316,995 B2 * 4/2016 Sumikura ..... G03G 21/0005
2016/0033890 A1 * 2/2016 Sumikura ..... G03G 15/04 347/118

FOREIGN PATENT DOCUMENTS

JP 2011-158566 8/2011

* cited by examiner

*Primary Examiner* — Hoang Ngo
(74) *Attorney, Agent, or Firm* — Wenderoth, Lind & Ponack, L.L.P.

(57) ABSTRACT

An optical scanning device includes a housing having light emitting ports extending in a predetermined direction, a transparent cover that closes the light emitting ports, a screw shaft arranged so as to extend in the predetermined direction along the transparent cover, a holding member having an engaging part engaged with the screw shaft, and a cleaning member held to the holing member. An abutting fulcrum is provided at an end of a movement path of the holing member, abuts a predetermined place of a surface of a front side in a progress direction of the holing member, allows the holing member to rotate by employing an abutting part of the holding member with the abutting fulcrum as a fulcrum, and reduces a position shift amount between the one side end portion and the other side end portion of the holing member in the progress direction.

12 Claims, 11 Drawing Sheets

OPTICAL SCANNING DEVICE AND IMAGE FORMING APPARATUS INCLUDING THE SAME

CROSS-REFERENCE TO RELATED APPLICATION

This application is based upon and claims the benefit of priority from Japanese Patent Application No. 2016-064661 filed on Mar. 28, 2016, the entire contents of which are incorporated herein by reference.

BACKGROUND

The technology of the present disclosure relates to an optical scanning device and an image forming apparatus including the same.

An image forming apparatus employing an electrophotographic system such as a copy machine and a printer includes an optical scanning device that emits light for forming an electrostatic latent image on a photoreceptor, and a developing device for developing the electrostatic latent image formed on the photoreceptor as a toner image.

The optical scanning device has a housing that receives a polygon mirror, an image forming lens and the like. The housing is formed with light emitting ports that emit light. The light emitting port includes an opening extending in a predetermined direction. The light emitting port is closed by a transparent cover such as a dustproof glass.

When dirt, dust and the like due to toner and the like are attached to the surface of the dustproof glass, there is a problem that the optical characteristics of the optical scanning device are deteriorated and thus image failure occurs. In this regard, there has been proposed a cleaning mechanism that regularly cleans the surface of the dustproof glass.

The cleaning mechanism has a screw shaft extending in the same direction as the extension direction of the dustproof glass, and a holding member that holds a cleaning member by engaging with the screw shaft.

The holding member has a cylindrical part fitted to the screw shaft, and an arm part that extends from the cylindrical part in a direction crossing the screw shaft and holds the cleaning member. The cylindrical part is provided on the inner peripheral surface thereof with a spiral protrusion portion (an engagement portion) that engages with a groove formed on the outer peripheral surface of the screw shaft. The groove of the outer peripheral surface of the screw shaft and the protrusion portion of the inner peripheral surface of the cylindrical part engage with each other and the screw shaft is rotated, so that the holding member moves along the screw shaft. The holding member reciprocally moves along a predetermined movement path when a motor is rotated forward and backward. By so doing, the cleaning member reciprocally moves while abutting the surface of the transparent cover, so that the surface of the transparent cover is cleaned by the cleaning member.

SUMMARY

An optical scanning device according to one aspect of the present disclosure includes a housing, a transparent cover, a screw shaft, a holding member, and a cleaning member. The housing has light emitting ports extending in a predetermined direction. The transparent cover closes the aforementioned light emitting ports. The screw shaft is arranged so as to extend in the predetermined direction along the transparent cover. The screw shaft is formed on a peripheral surface thereof with a spiral groove. The holding member is provided with an engaging part engaged with the groove of the screw shaft. The holding member reciprocally moves along a predetermined movement path along the screw shaft according to rotation of the screw shaft. The cleaning member is held to the holing member. The cleaning member cleans a surface of the transparent cover according to movement of the holing member.

The holing member is configured such that one side end portion in a direction perpendicular to the screw shaft is positioned at a front side in a progress direction as compared with the other side end portion when the holing member moves along an intermediate part except for both end portions of the aforementioned predetermined movement path. An abutting fulcrum is provided at an end of the aforementioned predetermined movement path. The abutting fulcrum abuts a predetermined place of a surface of a front side in the progress direction of the holing member, thereby allowing the holing member to rotate by employing an abutting part of the holding member with the abutting fulcrum as a fulcrum and reducing a position shift amount between the one side end portion and the other side end portion of the holing member in the aforementioned progress direction.

DETAILED DESCRIPTION

Hereinafter, embodiments of the present invention will be described in detail on the basis of the drawings. It is noted that the present invention is not limited to the following embodiments.

Embodiment

Figure 1:
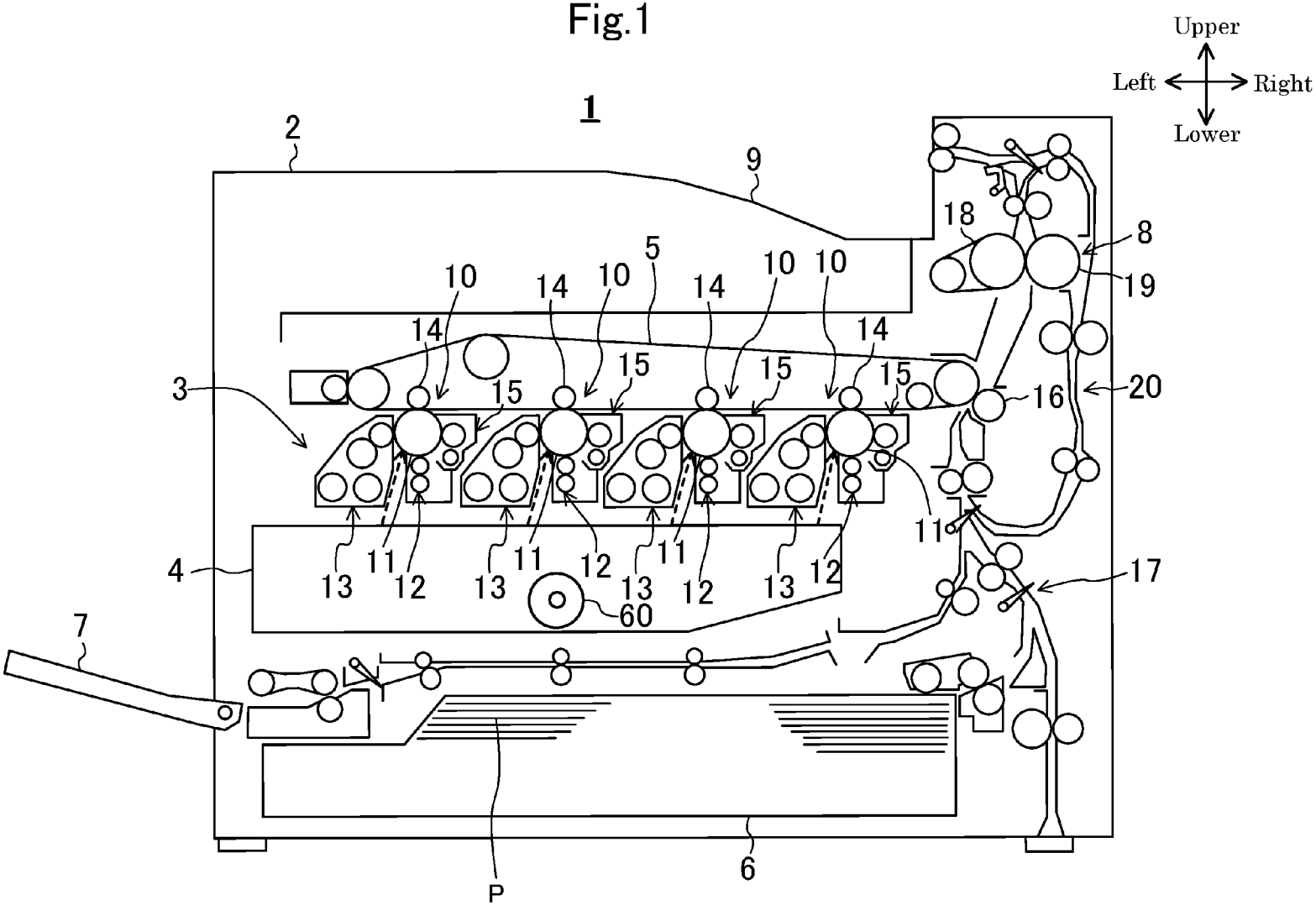
FIG. 1 is a schematic configuration diagram illustrating an image forming apparatus provided with an optical scanning device having a cleaning mechanism in an embodiment.

FIG. 1 illustrates a schematic configuration diagram of an image forming apparatus 1 in an embodiment of the present invention. In the following description, it is assumed that a front side and a rear side indicate a front side and a rear side (a front side and a back side in a direction vertical to the paper surface of FIG. 1) of the image forming apparatus 1, and a left side and a right side indicate a left side and a right side when the image forming apparatus 1 is viewed from the front side.

The image forming apparatus 1 is a tandem type color printer and includes an image forming unit 3 in a box-like casing 2. The image forming unit 3 transfers an image to a recording paper P and forms the image on the recording paper P on the basis of image data transmitted from an external device such as a computer subjected to network connection and the like. Below the image forming unit 3, an optical scanning device 4 is arranged to irradiate laser light, and above the image forming unit 3, a transfer belt 5 is arranged. Below the optical scanning device 4, a paper storage unit 6 is arranged to store the recording paper P, and at the left side of the paper storage unit 6, a manual paper feeding unit 7 is arranged. At a right upper part of the transfer belt 5, a fixing unit 8 is arranged to perform a fixing process on the image transferred to and formed on the recording paper P. A reference numeral 9 indicates a paper discharge unit arranged at an upper portion of the casing 2 to discharge the recording paper P subjected to the fixing process in the fixing unit 8.

The image forming unit 3 includes four image forming units 10 arranged in a row along the transfer belt 5. Each of the image forming units 10 has a photosensitive drum 11. Directly under each photosensitive drum 11, a charging device 12 is arranged, and at the left side of each photosensitive drum 11, a developing device 13 is arranged. Directly above each photosensitive drum 11, a primary transfer roller 14 is arranged, and at the right side of each photosensitive drum 11, a cleaning unit 15 is arranged to clean the peripheral surface of the photosensitive drum 11.

The peripheral surface of each photosensitive drum 11 is uniformly charged by the charging device 12, and laser light corresponding to each color based on the image data inputted from the aforementioned computer and the like is irradiated to the charged peripheral surface of each photosensitive drum 11 from the optical scanning device 4, so that an electrostatic latent image is formed on the peripheral surface of each photosensitive drum 11. A developer is supplied to the electrostatic latent image from the developing device 13, so that a toner image of yellow, magenta, cyan, or black is formed on the peripheral surface of each photosensitive drum 11. These toner images are respectively superposed on and transferred to the transfer belt 5 by a transfer bias applied to the primary transfer roller 14.

A reference numeral 16 indicates a secondary transfer roller arranged below the fixing unit 8 in the state of abutting the transfer belt 5, wherein the recording paper P conveyed along a paper conveyance path 17 from the paper storage unit 6 or the manual paper feeding unit 7 is interposed between the secondary transfer roller 16 and the transfer belt 5, and the toner images on the transfer belt 5 are transferred to the recording paper P by a transfer bias applied to the secondary transfer roller 16.

The fixing unit 8 includes a heating roller 18 and a pressure roller 19, wherein the recording paper P is interposed by the heating roller 18 and the pressure roller 19 so as to be pressed while being heated, so that the toner images, which have been transferred to the recording paper P, are fixed to the recording paper P. The recording paper P subjected to the fixing process is discharged to the paper discharge unit 9. A reference numeral 20 indicates a reversing conveyance path for reversing the recording paper P discharged from the fixing unit 8 at the time of duplex printing.

—Details of Optical Scanning Device—

Figure 2:
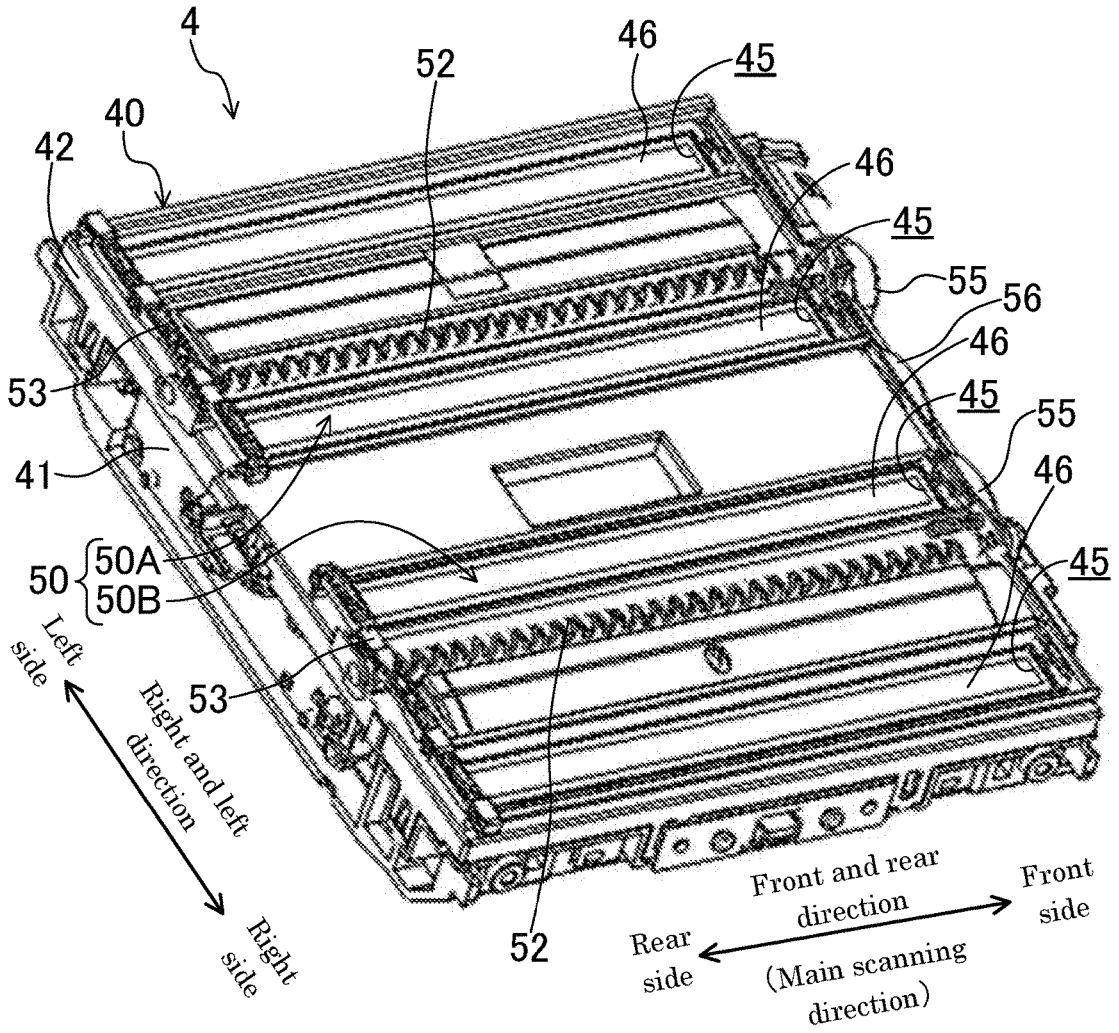
FIG. 2 is an external appearance perspective view of an optical scanning device.

FIG. 2 is an external appearance perspective view of the optical scanning device 4. The optical scanning device 4 includes a sealed box-like housing 40. The housing 40 includes a bottomed box-like housing body 41 in which a ceiling side is opened, and a lid member 42 that closes the ceiling side of the housing body 41.

Figure 3:
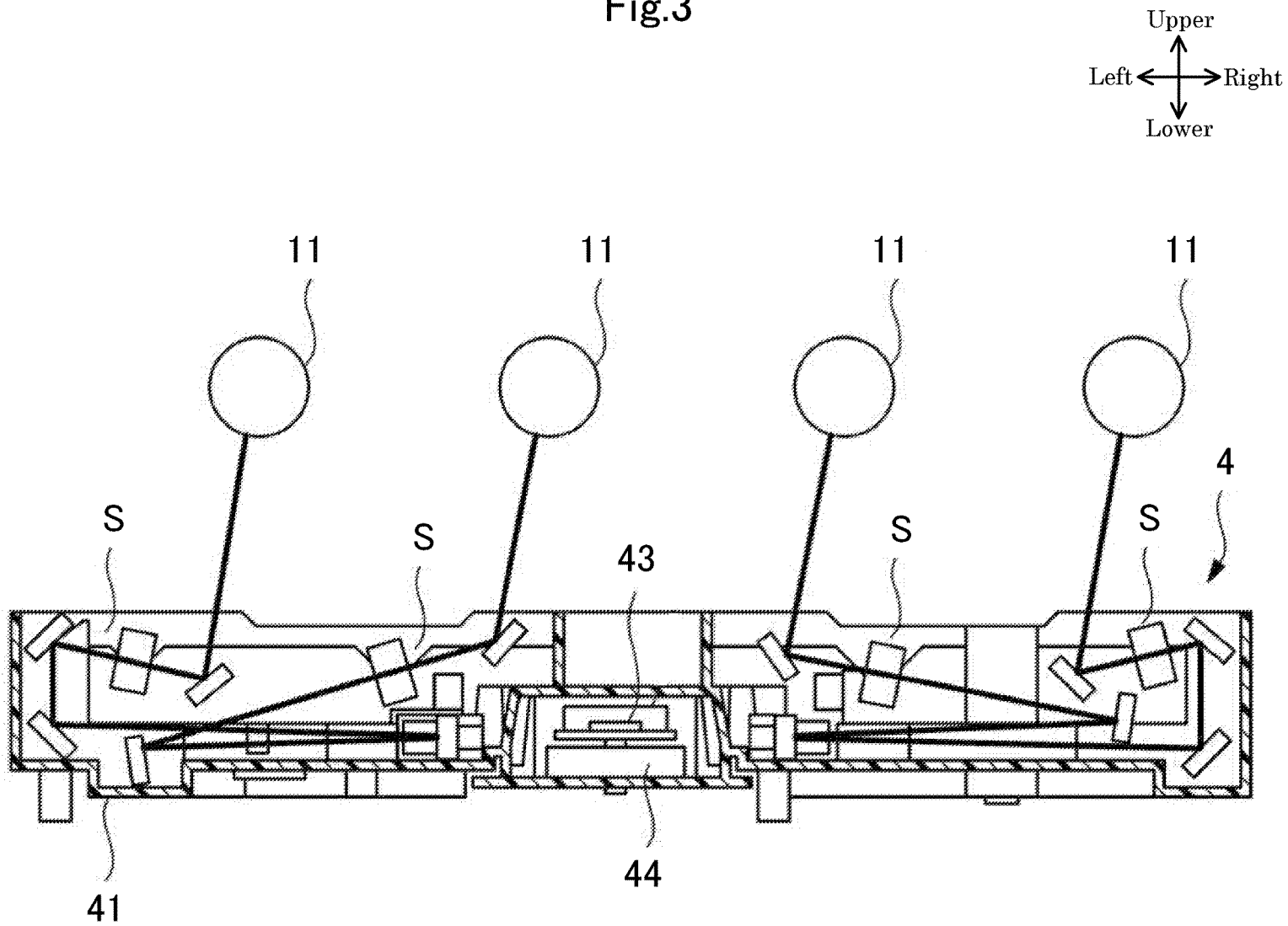
FIG. 3 is a schematic diagram illustrating an internal structure of a housing body of an optical scanning device.

FIG. 3 is a sectional view illustrating a state in which the lid member 42 has been detached from the housing 40 of the optical scanning device 4. At a center portion of a bottom wall of the housing body 41, a polygon mirror 43 and a driving motor 44 for rotationally driving the polygon mirror 43 are arranged. The polygon mirror 43 deflects and scans laser light for electrostatic latent image writing, which is emitted from a light source and corresponds to each color of magenta (M), cyan (C), yellow (Y), and black (K). At the bottom wall of the housing body 41, two pairs of scanning optical systems S, that is, total four scanning optical systems S are arranged at both sides of the polygon mirror 43 while interposing the polygon mirror 43 therebetween. The four scanning optical systems S guide the laser light, which corresponds to each color of the magenta (M), the cyan (C), the yellow (Y), and the black (K), to the surface of the surface of each photosensitive drum 11. Each of the scanning optical systems S, for example, is configured by a fθ lens, a reflecting mirror and the like.

As illustrated in FIG. 2, the lid member 42 is formed with two sets of (total four) light emitting ports 45 through which the laser light emitted from the scanning optical systems S passes, wherein one set of light emitting ports 45 form a pair. Each light emitting port 45 includes a rectangular opening extending in a main scanning direction (a front and rear direction). The light emitting ports 45 are formed in parallel with one another in a right and left direction. Each light emitting port 45 is covered by a transparent dustproof glass (a transparent cover) 46 that allows light to pass therethrough. Each dustproof glass 46 covering each light emitting port 45 is formed in a rectangular plate shape long in the main scanning direction. The surface of each dustproof glass 46 is automatically cleaned by an automatic cleaning mechanism 50. The automatic cleaning mechanism 50 has a first automatic cleaning part 50A and a second automatic cleaning part 50B. The first automatic cleaning part 50A and the second automatic cleaning part 50B are symmetrically arranged while interposing a center portion of the housing 40 in the longitudinal direction (the right and left direction) of the housing 40. The first automatic cleaning part 50A cleans two dustproof glasses 46 through which the laser light of the magenta (M) and the cyan (C) passes. The second automatic cleaning part 50B cleans two dustproof glasses 46 through which the laser light of the yellow (Y) and the black (K) passes. The first automatic cleaning part 50A and the second automatic cleaning part 50B are driven by one common driving motor 60 (see FIG. 1). In the present embodiment, the driving motor 60 is configured separately from the optical scanning device 4.

Figure 4:
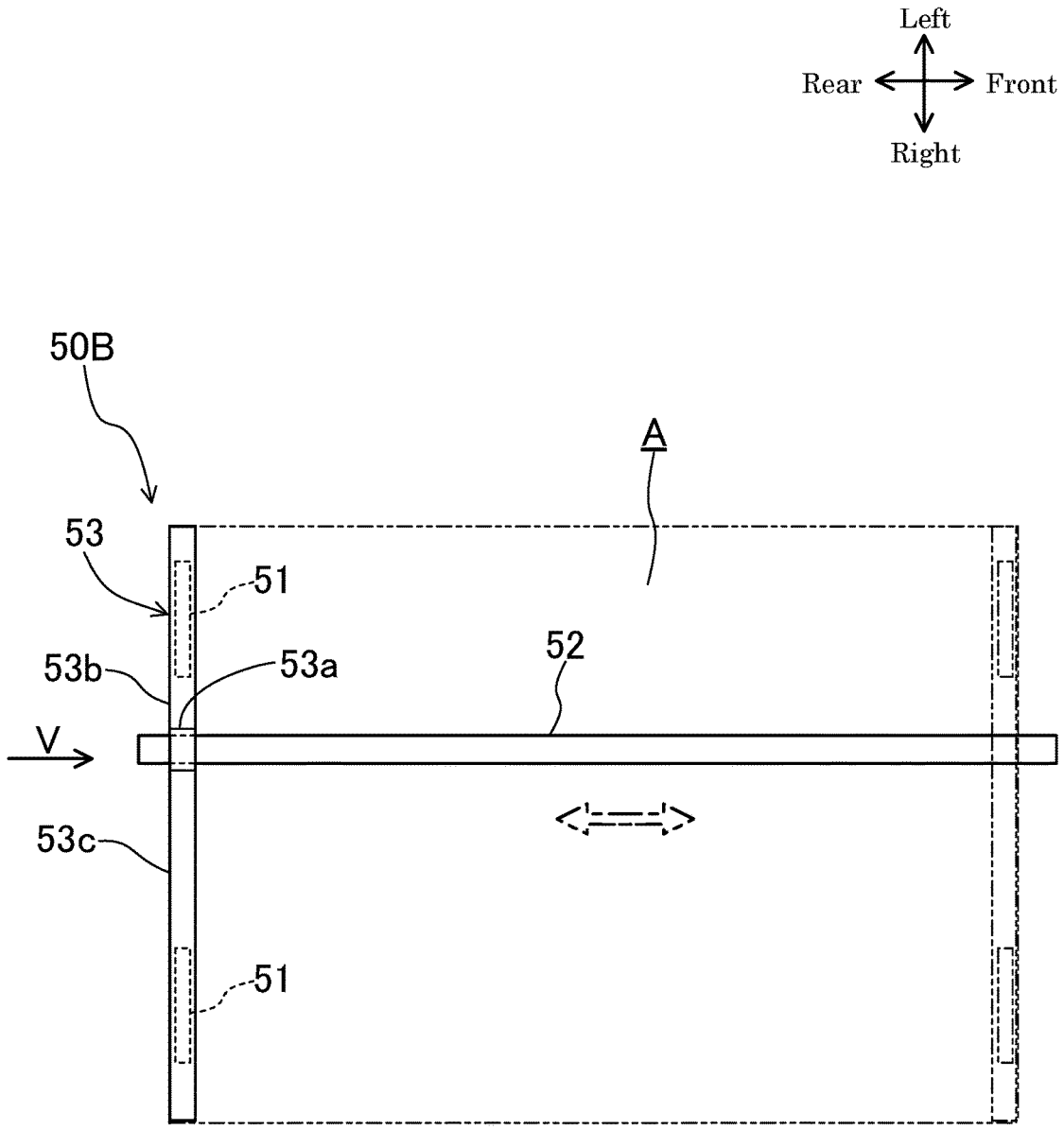
FIG. 4 is a schematic plan view illustrating an automatic cleaning part.
Figure 5:
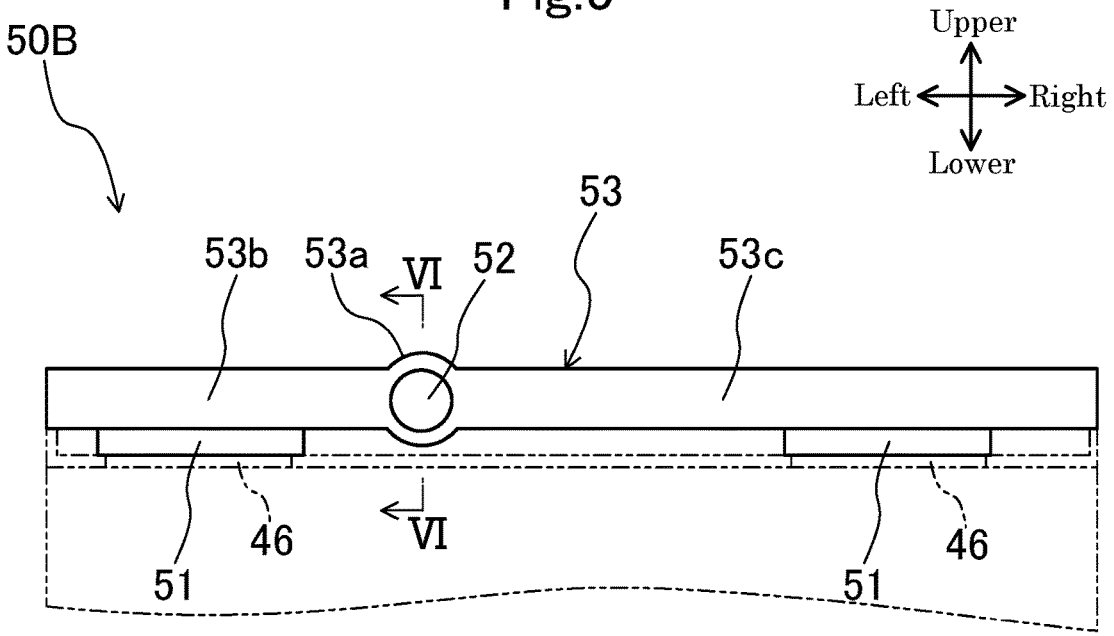
FIG. 5 is a view viewed in the arrow direction of V of FIG. 4.

Since the first automatic cleaning part 50A and the second automatic cleaning part 50B have the same configuration, only the second automatic cleaning part 50B will be described with reference to FIG. 4 and FIG. 5 and a description of the first automatic cleaning part 50A will be omitted below.

The second automatic cleaning part 50B has a screw shaft arranged between a pair of light emitting ports 45, a holding member 53 reciprocally driven by the screw shaft 52, and a pair of cleansing members 51 held by the holding member 53.

The screw shaft 52 is arranged so as to extend in the front and rear direction. Both end portions of the screw shaft 52 in an axial direction (the front and rear direction) are supported to be rotatable to a bearing part (not illustrated) formed on the lid member 42 of the housing 40. The screw shaft 52 is mounted at one end portion thereof with a driving gear 55 (illustrated only in FIG. 2). The driving gear 55 engages with an idle gear 56 supported to a sidewall surface of the housing body 41. The idle gear 56 is connected to the driving motor 60 via a gear mechanism provided in the image forming apparatus 1 when the optical scanning device 4 is assembled to a predetermined position of the image forming apparatus 1. The screw shaft 52 is formed on the outer peripheral surface thereof with a spiral groove 52*a* (see FIG. 6). The spiral groove 52*a* is formed in the screw shaft 52 in the whole axial direction.

The holding member 53 has a cylindrical nut part 53*a* fitted to the screw shaft 52, and a first holding plate 53*b* and a second holding plate 53*c* connected to the cylindrical nut part 53*a*.

Figure 6:
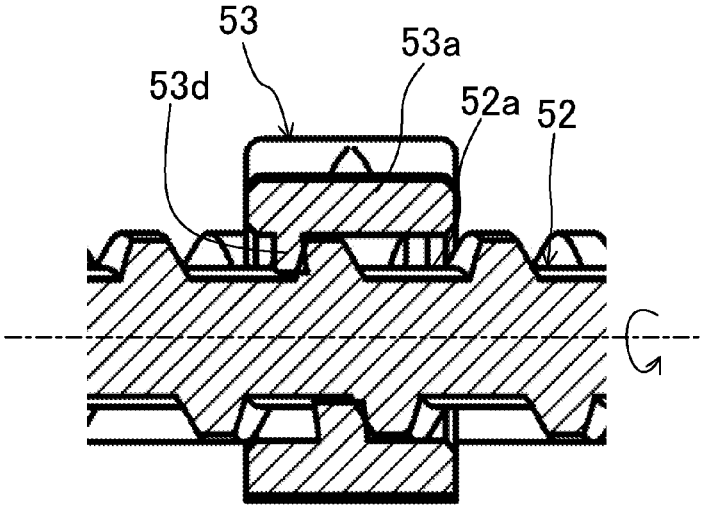
FIG. 6 is a sectional view taken along line VI-VI of FIG. 5.

The cylindrical nut part 53*a* is formed in an approximately cylindrical shape and is provided on the inner peripheral surface thereof with an engaging protrusion part (an engaging part) 53*d* engaged with the spiral groove 52*a* (see FIG. 6). The engaging protrusion part 53*d* protrudes radially inside from the inner peripheral surface of the cylindrical nut part 53*a*. The engaging protrusion part 53*d* is formed in a spiral shape around the axial center of the cylindrical nut part 53*a*.

The first holding plate 53*b* extends leftward (one light emitting port 45 side) from an upper end portion of the cylindrical nut part 53*a*, and the second holding plate 53*c* extends rightward (the other light emitting port 45 side) from the upper end portion of the cylindrical nut part 53*a*. The first holding plate 53*b* and the second holding plate 53*c* are arranged on the same straight line extending in the right and left direction when viewed from an upper side. A length from a proximal end to a distal end of the first holding plate 53*b* is shorter than a length from a proximal end to a distal end of the second holding plate 53*c*. The first holding plate 53*b* and the second holding plate 53*c* are mounted at the lower surfaces thereof with the cleansing members 51, respectively. The first holding plate 53*b* is mounted at a front side surface and a rear side surface thereof with compression coil springs 60*f* and 60*r* (illustrated only in FIG. 7 and FIG. 8), respectively. The compression coil springs 60*f* and 60*r* have a function of pushing back the holding member 53 and allowing the cylindrical nut part 53*a* to be reliably engaged with the spiral groove 52*a* of the screw shaft 52 when the holding member 53 has reached a end of a movement path A.

The each cleansing member 51 is formed by an elastic blade member (for example, a silicon pad). The cleansing members 51 are provided at positions corresponding to a pair of dustproof glasses 46 to be cleaned by the automatic cleaning parts 50A and 50B. That is, each cleansing member 51 is provided at a position overlapping each dustproof glass 46 in a plan view. Each cleansing member 51 is interposed between the holding plates 53*b*, 53*c* and the dustproof glass 46 and is compressed with a light load in a thickness direction. By so doing, each cleansing member 51 is pressed to the dustproof glass 46 at a predetermined pressing force.

When the automatic cleaning mechanism 50 operates, the screw shaft 52 is rotationally driven in both forward and backward directions by the driving motor 60. By so doing, the holding member 53 reciprocally moves along the predetermined movement path A. The movement path A is a linear movement path extending in the front and rear direction.

The movement path A is surrounded by a front sidewall 42*a* and a rear sidewall 42*b* facing each other in the front and rear direction (see FIG. 9 and FIG. 10), and a left sidewall 42*c* and a right sidewall 42*d* facing each other in the right and left direction. The walls 42*a* to 42*d* are vertically upright from the upper surface of the lid member 42. The front sidewall 42*a* and the rear sidewall 42*b* are provided with bearing parts (not illustrated) that rotatably support the screw shaft 52. The left sidewall 42*c* and the right sidewall 42*d* support both end portions in the longitudinal direction of the holding member 53 from below and guide the movement in the front and rear movement of the holding member 53.

Figure 7:
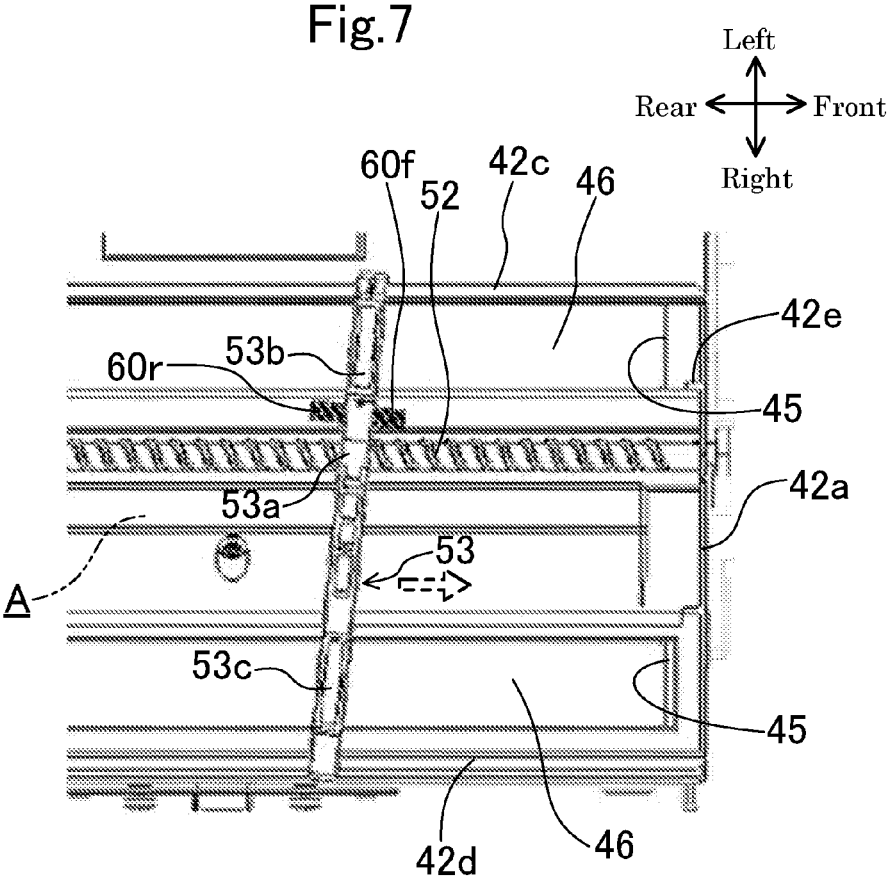
FIG. 7 is a plan view illustrating a state in which a holding member moves from a rear side to a front side when a screw shaft is rotated forward.
Figure 8:
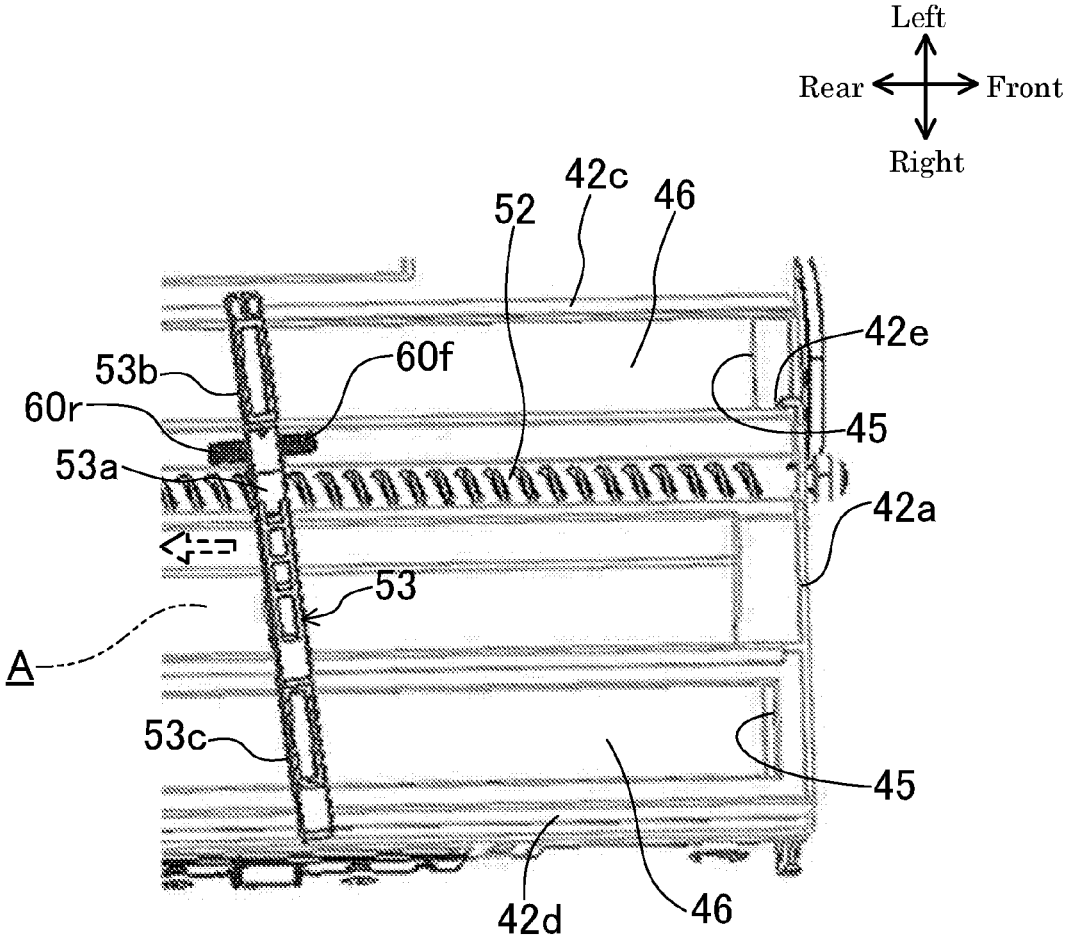
FIG. 8 is a plan view illustrating a state in which a holding member moves from a front side to a rear side when a screw shaft is rotated backward.

FIG. 7 and FIG. 8 illustrate the states in which the screw shaft 52 rotates forward and backward. In all the cases, the holding member 53 is inclined at an angle of 10° to 30° with respect to a direction perpendicular to the screw shaft 52. That is, the holding member 53 is inclined such that its left side end portion proceeds frontward in a progress direction as compared with a right side end portion. In other words, the holding member 53 is inclined such that the first holding plate 53*b* is positioned frontward in the progress direction as compared with the second holding plate 53*c*. This is caused when the holding member 53 is driven by engagement of the spiral groove 52*a* formed in the outer peripheral surface of the screw shaft 52 and the engaging protrusion part 53*d* formed at the cylindrical nut part 53*a* of the holding member 53. As long as such a driving mode is employed, the holding member 53 is inclined according the fitting precision of the spiral groove 52*a* of the screw shaft 52 and the engaging protrusion part 53*d*.

Figure 12:
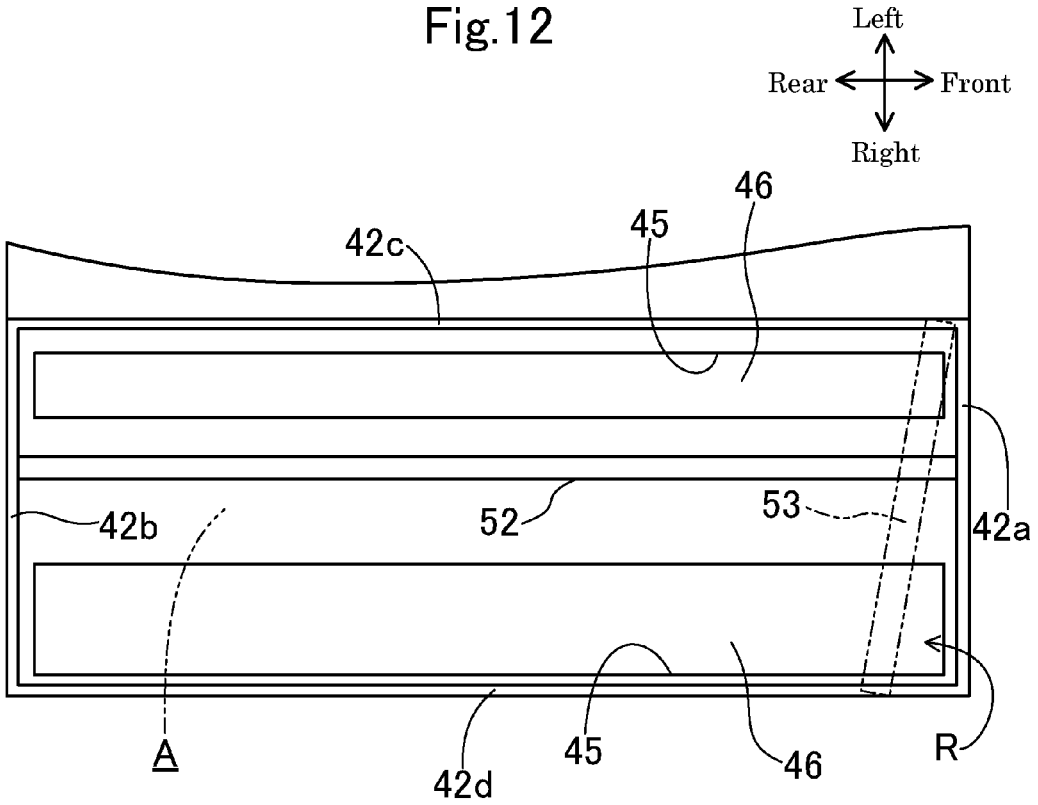
FIG. 12 is a plan view illustrating a state in which a holding member is positioned at a front side end of a movement path in an optical scanning device of a conventional example.
Figure 13:
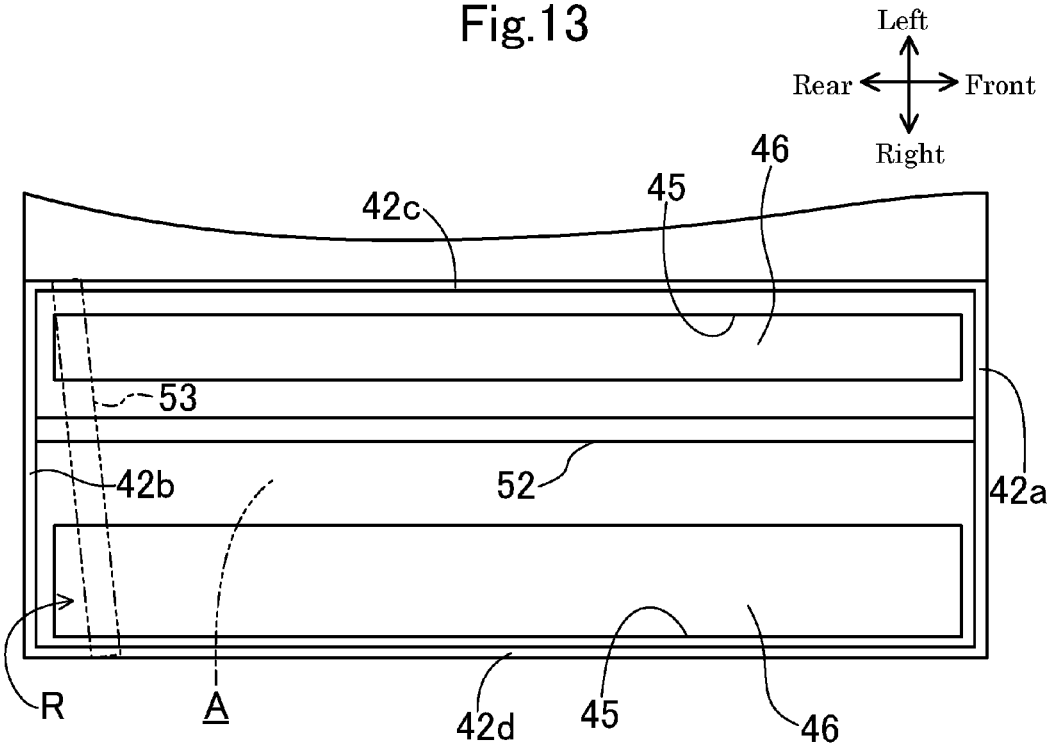
FIG. 13 is a plan view illustrating a state in which a holding member is positioned at a rear side end of a movement path in an optical scanning device of a conventional example.

Therefore, in the conventional optical scanning device, there is a problem that when the holding member 53 has reached the end of the movement path A, an end portion opposite to a preceding side in the holding member 53 is not able to reach the end portion of the dustproof glass 46. Therefore, since an unwiped region R (see FIG. 12 and FIG. 13) not cleaned by the cleansing member 51 occurs at a front end portion and a rear end portion of the dustproof glass 46, the optical performance of the optical scanning device may be deteriorated.

In the present embodiment, in order to solve this problem, a front side protrusion part 42*e* and a rear side protrusion part 42*f* serving as abutting support parts are respectively formed at the front sidewall 42*a* and the rear sidewall 42*b* positioned in the end of the movement path A of the holding member 53. Specifically, the front side protrusion part 42*e* protrudes rearward from a side surface of the front sidewall 42*a* as illustrated in FIG. 7, and the rear side protrusion part 42*f* protrudes frontward from a side surface of the rear sidewall 42*b*. Both protrusion parts 42*e* and 42*f* are formed in a rectangular column shape. A distal end of the front side protrusion part 42*e* is positioned forward from an extension line of a front side end edge of the dustproof glass 46 when viewed from an upper side (when viewed from a direction vertical to the dustproof glass 46). Similarly, a distal end of the rear side protrusion part 42*f* is positioned rearward from an extension line of a rear side end edge of the dustproof glass 46 when viewed from the upper side. Both protrusion parts 42*e* and 42*f* are arranged so as to abut predetermined places of the front side surface in the progress direction of the holding member 53 when the holding member 53 has reached the end of the movement path A (the front side end and the rear side end). The predetermined places are positioned at a left side of a center position of the holding member 53 in a direction (the right and left direction) perpendicular to the screw shaft 52. Furthermore, the predetermined places are positioned at a left side of the screw shaft 52.

Figure 9:
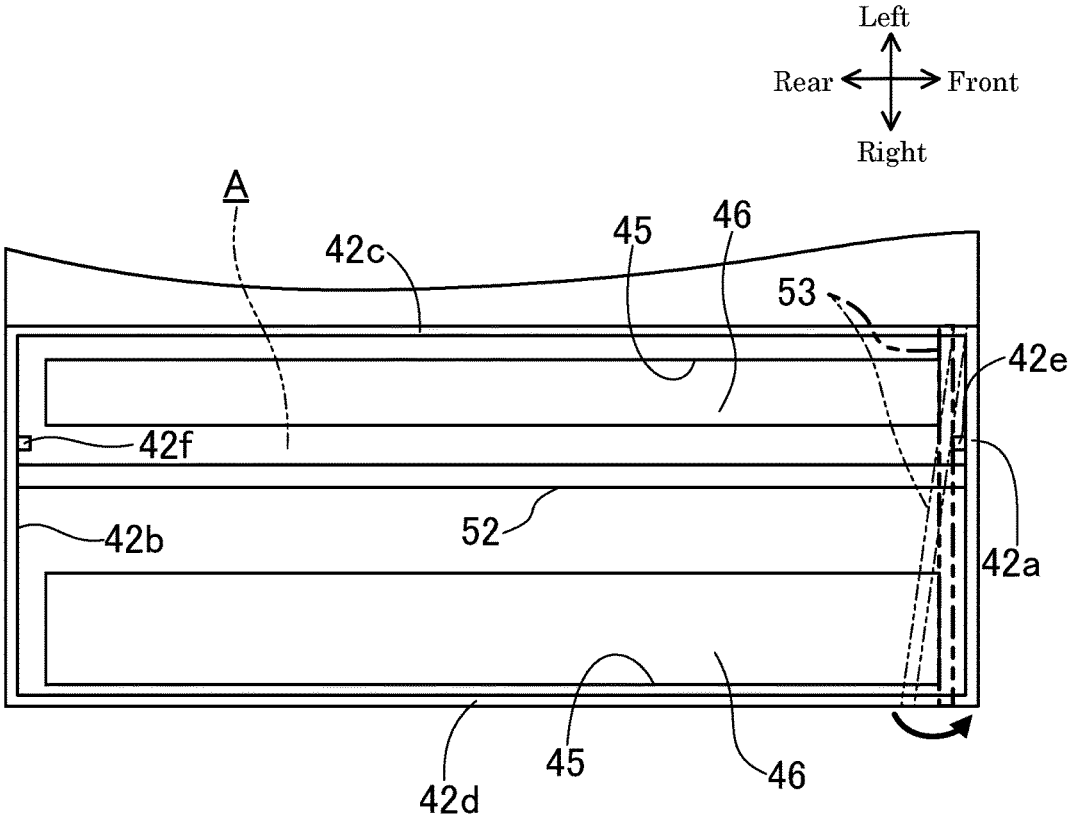
FIG. 9 is an explanation diagram illustrating a process in which the inclination of a holding member is corrected at a front side end of a movement path of the holding member.
Figure 10:
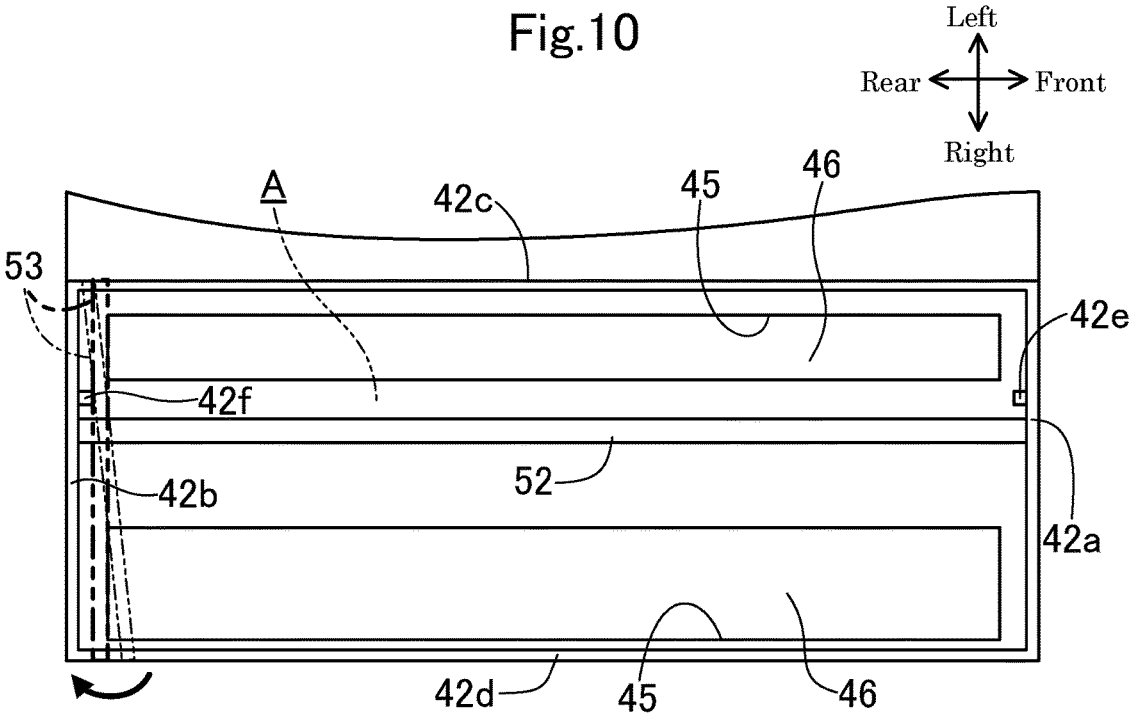
FIG. 10 is an explanation diagram illustrating a process in which the inclination of a holding member is corrected at a rear side end of a movement path of the holding member.

FIG. 9 and FIG. 10 are schematic diagrams illustrating aspects in which the inclination of the holding member 53 is corrected by the front side protrusion part 42*e* and the rear side protrusion part 42*f*. As illustrated in FIG. 9, when the holding member 53 has reached the front side end of the movement path A, the front side protrusion part 42*e* abuts the front side surface in the progress direction of the holding member 53 (see a thin two dot chain line). In this state, propulsive force is applied to the holding member 53 from the screw shaft 52, so that the holding member 53 rotates counterclockwise (a thick arrow direction) of the drawing by employing an abutting part with the front side protrusion part 42*e* as a fulcrum. As a consequence, a position shift amount between the left side end portion and the right side end portion of the holding member 53 in the progress direction is reduced, so that the holding member 53 stops in the state of being perpendicular to the screw shaft 52. Consequently, it is possible to allow the right side end portion of the holding member 53 to reliably reach the front end portion of the dustproof glass 46. Thus, no unwiped region R (see FIG. 12) due to the cleansing member 51 is generated at the front end portion of the dustproof glass 46 as with the conventional art. It is noted that the stop position of the holding member 53 is a front side of the front side end edge of the dustproof glass 46. The dustproof glass 46 is formed at the front side thereof with a concave section, so that dust and the like collected by the cleansing member 51 are dropped to the concave section. Consequently, it is possible to prevent dust and the like from being attached to and left to the dustproof glass 46.

Similarly, as illustrated in FIG. 10, when the holding member 53 has reached the rear side end of the movement path A, the rear side protrusion part 42*f* abuts the front side surface in the progress direction of the holding member 53 and the holding member 53 receives propulsive force from the screw shaft 52 in this state, so that the holding member 53 rotates clockwise (a thick arrow direction) of the drawing by employing an abutting part with the rear side protrusion part 42*f* as a fulcrum. As a consequence, the position shift amount between the left side end portion and the right side end portion of the holding member 53 in the progress direction is reduced, so that the holding member 53 stops in the state of being perpendicular to the screw shaft 52. Consequently, no unwiped region R (see FIG. 13) due to the cleansing member 51 is generated at the rear end portion of the dustproof glass 46 as with the conventional art. It is noted that the stop position of the holding member 53 is a rear side of the rear side end edge of the dustproof glass 46. The dustproof glass 46 is formed at the rear side thereof with a concave section, to which dust and the like are dropped, similarly to the front side thereof, so that it is possible to prevent dust and the like from being attached to and left to the dustproof glass 46.

In addition, in the present embodiment, the abutting place (the predetermined place) of the holding member 53 with the front side protrusion part 42*e* or the rear side protrusion part 42*f* is positioned at a left side of the center position of the holding member 53 in the direction (the right and left direction) perpendicular to the screw shaft 52, that is, a preceding side of both right and left sides of the holding member 53. By so doing, the holding member 53 is easily rotated by employing the front side protrusion part 42*e* or the rear side protrusion part 42*f* as a fulcrum. Thus, it is possible to more reliably obtain an inclination correction effect of the holding member 53 by the front side protrusion part 42*e* and the rear side protrusion part 42*f*.

Furthermore, the front side protrusion part 42*e* and the rear side protrusion part 42*f* are positioned at the left side (the preceding side of both right and left sides of the holding member 53) of the screw shaft 52. According to this, it is possible to reliably convert propulsive force applied to the holding member 53 from the screw shaft 52 into a moment in a direction in which the inclination of the holding member 53 is corrected. Thus, it is possible to enhance an inclination correction effect of the holding member 53 by the front side protrusion part 42*e* and the rear side protrusion part 42*f*.

OTHER EMBODIMENTS

Figure 11:
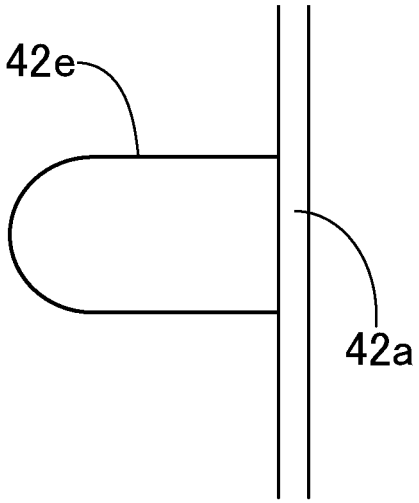
FIG. 11 is a schematic plan view illustrating an abutting fulcrum of an optical scanning device of another embodiment.

In the aforementioned embodiment, the example, in which the front side protrusion part 42*e* and the rear side protrusion part 42*f* are formed in a rectangular column shape, is illustrated; however, the present invention is not limited thereto, and for example, as illustrated in FIG. 11, the front side protrusion part 42*e* and the rear side protrusion part 42*f* may be formed in a curved shape in which their distal end portions (surfaces facing the holding member 53) protrude to the holding member 53 side (that is, an abutted member side). As the curved shape, a spherical shape or a cylindrical shape is considered; however, the cylindrical shape is preferable in terms of the reduction of a contact surface pressure between each of the protrusion parts 42*e*, 42*f* and the holding member 53.

Figure 14:
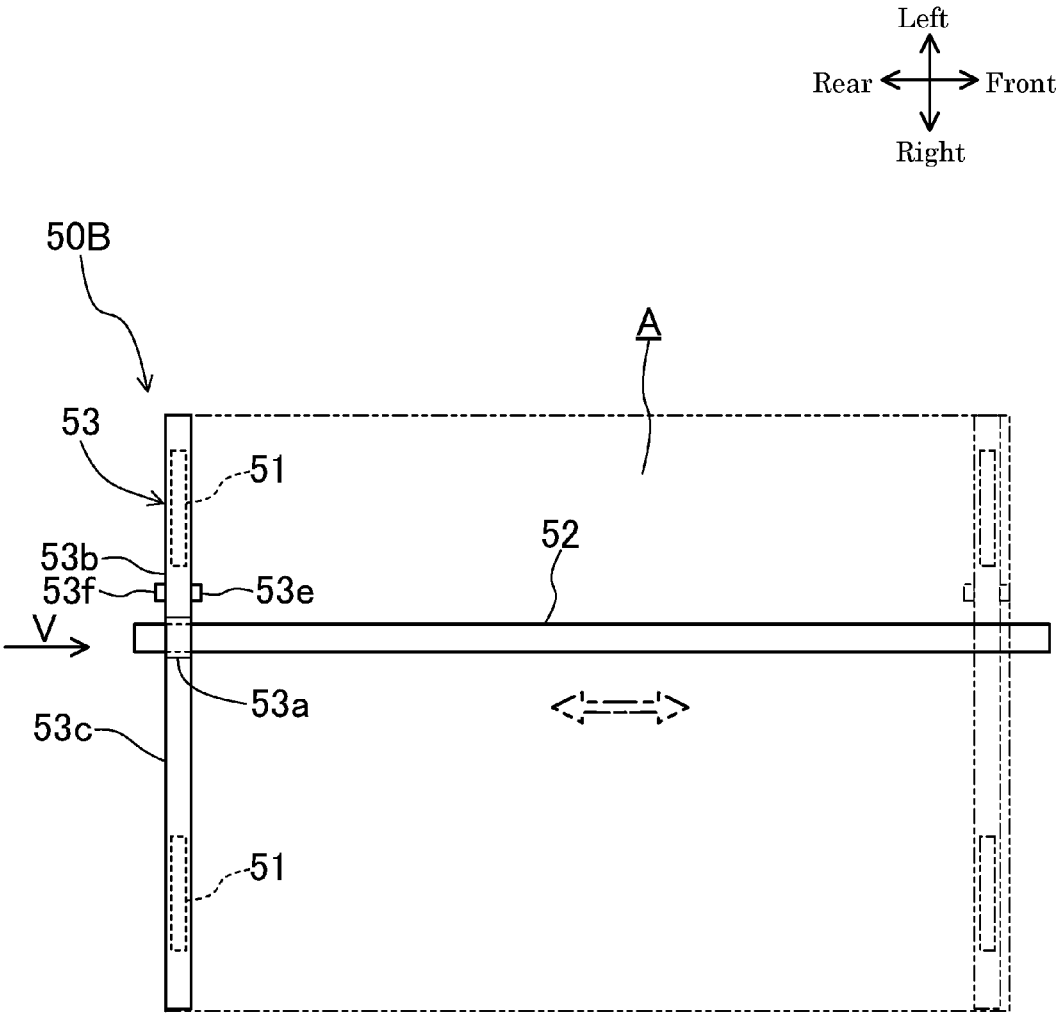
FIG. 14 is a view corresponding to FIG. 4, which illustrates another embodiment.

In the aforementioned embodiment, the front side protrusion part 42*e* and the rear side protrusion part 42*f* serving as abutting fulcrums are formed at the front sidewall 42*a* and the rear sidewall 42*b* positioned at the end of the movement path A of the holding member 53; however, the present invention is not limited thereto. That is, instead of abolishing the front side protrusion part 42*e* and the rear side protrusion part 42*f*, a front side protrusion part 53*e* and a rear side protrusion part 53*f* may be respectively formed at the front side surface and the rear side surface of the holding member 53 as abutting fulcrums as illustrated in FIG. 14. It is sufficient if a positional relation of the front side protrusion part 53*e* and the rear side protrusion part 53*f* with respect to the screw shaft 52 is similar to the positional relation of the front side protrusion part 42*e* and the rear side protrusion part 42*f* in the aforementioned embodiment. By so doing, it is possible to obtain operations and effects similarly to those of the aforementioned embodiment. It is noted that in the case of employing this embodiment, the front side protrusion part 53*e* and the rear side protrusion part 53*f* may be formed in a curved shape in which their distal end portions (surfaces facing the front sidewall 42*a* and the rear sidewall 42*b*) protrude to the walls 42*a* and 42*b* sides (that is, abutted member sides).

Furthermore, the technologies of the present disclosure are not limited to the aforementioned embodiments, and include configurations obtained by appropriately combining the aforementioned embodiments with each other.

What is claimed is:

1. An optical scanning device comprising:

a housing having light emitting ports extending in a predetermined direction;

a transparent cover that closes the light emitting ports;

a screw shaft arranged so as to extend in the predetermined direction along the transparent cover and formed on a peripheral surface thereof with a spiral groove;

a holding member provided with an engaging part engaged with the groove of the screw shaft and configured to reciprocally move along a predetermined movement path along the screw shaft according to rotation of the screw shaft; and a cleaning member held to the holding member and cleaning a surface of the transparent cover according to movement of the holding member, wherein the holding member is configured such that one side end portion in a direction perpendicular to the screw shaft is positioned at a front side in a progress direction as compared with the other side end portion when the holding member moves along an intermediate part except for both end portions of the predetermined movement path, and an abutting fulcrum is provided at an end of the predetermined movement path and abuts a predetermined place of a surface of a front side in the progress direction of the holding member, thereby allowing the holding member to rotate by employing an abutting part of the holding member with the abutting fulcrum as a fulcrum, and reducing a position shift amount between the one side end portion and the other side end portion of the holding member in the progress direction.

2. The optical scanning device of claim 1, wherein the predetermined place is positioned at the one side of a center position of the holding member in the direction perpendicular to the screw shaft.

3. The optical scanning device of claim 1, wherein the predetermined place is positioned at the one side of an axial center of the screw shaft.

4. The optical scanning device of claim 1, wherein an abutting surface with an abutted member in the abutting fulcrum is formed in a curved shape protruding to the abutted member side.

5. The optical scanning device of claim 1, wherein the light emitting ports are provided as a pair of one set, the pair of light emitting ports being formed in parallel with each other, the screw shaft is provided between the pair of light emitting ports, the holding member including a cylindrical nut part fitted to the screw shaft and having the engaging part on an inner peripheral surface, a first holding plate extending to one light emitting port side from the cylindrical nut part to hold the cleaning member, and a second holding plate extending to the other light emitting port side from the cylindrical nut part to hold the cleaning member, a length from a proximal end to a distal end of the first holding plate is shorter than a length from a proximal end to a distal end of the second holding plate, and the one side is a side in which the first holding plate is positioned and the other side is a side in which the second holding plate is positioned.

6. An image forming apparatus including the optical scanning device of claim 1.

7. An optical scanning device comprising:

a housing having light emitting ports extending in a predetermined direction;

a transparent cover that closes the light emitting ports;

a screw shaft arranged so as to extend in the predetermined direction along the transparent cover and formed on a peripheral surface thereof with a spiral groove;

a holding member formed with an engaging part engaged with the groove of the screw shaft and configured to reciprocally move along a predetermined movement path along the screw shaft according to rotation of the screw shaft; and a cleaning member held to the holding member and cleaning a surface of the transparent cover according to movement of the holding member, wherein the holding member is configured such that one side end portion in a direction perpendicular to the screw shaft is positioned at a front side in a progress direction as compared with the other side end portion when the holding member moves along an intermediate part except for both end portions of the predetermined movement path, and an abutting fulcrum is provided at a predetermined place of a surface of a front side in the progress direction of the holding member and abuts a wall formed at an end when the holding member reaches the end of the predetermined movement path, thereby allowing the holding member to rotate by employing an abutting part of the holding member with the abutting fulcrum as a fulcrum and reducing a position shift amount between the one side end portion and the other side end portion of the holding member in the progress direction.

8. The optical scanning device of claim 7, wherein the predetermined place is positioned at the one side of a center position of the holding member in the direction perpendicular to the screw shaft.

9. The optical scanning device of claim 7, wherein the predetermined place is positioned at the one side of an axial center of the screw shaft.

10. The optical scanning device of claim 7, wherein an abutting surface with an abutted member in the abutting fulcrum is formed in a curved shape protruding to the abutted member side.

11. The optical scanning device of claim 7, wherein the light emitting ports are provided as a pair of one set, the pair of light emitting ports being formed in parallel with each other, the screw shaft is provided between the pair of light emitting ports, the holding member including a cylindrical nut part fitted to the screw shaft and having the engaging part on an inner peripheral surface, a first holding plate extending to one light emitting port side from the cylindrical nut part to hold the cleaning member, and a second holding plate extending to the other light emitting port side from the cylindrical nut part to hold the cleaning member, a length from a proximal end to a distal end of the first holding plate is shorter than a length from a proximal end to a distal end of the second holding plate, and the one side is a side in which the first holding plate is positioned and the other side is a side in which the second holding plate is positioned.

12. An image forming apparatus including the optical scanning device of claim 7.

* * * * *